US008935819B1

(12) United States Patent
Hartley

(10) Patent No.: US 8,935,819 B1
(45) Date of Patent: Jan. 20, 2015

(54) MATTRESS FOUNDATIONS, KITS AND RELATED METHODS

(71) Applicant: Rick Hartley, High Point, NC (US)

(72) Inventor: Rick Hartley, High Point, NC (US)

( * ) Notice: Subject to any disclaimer, the term of this patent is extended or adjusted under 35 U.S.C. 154(b) by 0 days.

(21) Appl. No.: 13/625,378

(22) Filed: Sep. 24, 2012

Related U.S. Application Data

(60) Provisional application No. 61/537,801, filed on Sep. 22, 2011.

(51) Int. Cl.
*A47C 19/02* (2006.01)
*A47C 23/00* (2006.01)

(52) U.S. Cl.
CPC ..... *A47C 23/00* (2013.01)
USPC ..... 5/400; 5/200.1; 5/236.1

(58) Field of Classification Search
USPC ..... 5/400, 201, 200.1, 236.1, 239, 244, 241
See application file for complete search history.

(56) References Cited

U.S. PATENT DOCUMENTS

| | | | | |
|---|---|---|---|---|
| 3,469,589 | A | 9/1969 | Mitchell | 135/87 |
| 3,842,451 | A | 10/1974 | McCormick | 5/200 R |
| 4,074,372 | A | 2/1978 | Schulz, Jr. | 5/263 |
| 4,181,991 | A | 1/1980 | Morgan et al. | 5/400 |
| 4,535,494 | A * | 8/1985 | Diamonstein | 5/400 |
| 5,758,372 | A | 6/1998 | Lopez Diaz | 5/200.1 |
| 6,058,535 | A | 5/2000 | Firkins, Jr. et al. | 5/653 |
| 7,937,788 | B2 | 5/2011 | Felix | 5/201 |
| 8,042,205 | B2 | 10/2011 | Schulz, Jr. | 5/200.1 |
| 2007/0151026 | A1 | 7/2007 | Felix | 5/201 |
| 2008/0208709 | A1 | 8/2008 | Craver | 705/27 |
| 2008/0235868 | A1 | 10/2008 | Snitzer et al. | 5/201 |
| 2010/0154118 | A1 | 6/2010 | Pearce | 5/201 |
| 2010/0170190 | A1 | 7/2010 | Schulz, Jr. | 52/745.19 |
| 2013/0000038 | A1 | 1/2013 | Schulz, Jr. | 5/400 |

* cited by examiner

*Primary Examiner* — Peter M Cuomo
*Assistant Examiner* — Brittany Wilson
(74) *Attorney, Agent, or Firm* — MacCord Mason PLLC

(57) ABSTRACT

Mattress foundations and kits include a first side rail, a second side rail, a first end rail, a second end rail, and at least one center rail. The foundations and kits further include a plurality of slats of varying lengths. The invention may further include a method of assembling a foundation kit.

22 Claims, 7 Drawing Sheets

MATTRESS FOUNDATIONS, KITS AND RELATED METHODS

BACKGROUND

The current disclosure relates generally to foundations for mattresses to increase mattress support, and more particularly to foundations having novel slat construction to improve mattress support.

While traditional foundations are sufficient in many situations, applicant believes that in some situations, improvement can be made. By way of example, in some situations, a sleeper's downward force on traditional slats may cause the mattress to dip in between the slats of the foundation (referred to herein generally as "mattress dip"). Applicant believes mattress dip may be caused by any of a number of problems, including at least one of mattress spring position relative to the slat, spring size, slat size, slat spacing, sleeper weight, sleeper habits, etc. Regardless of the cause, applicant believes mattress dip can result in decreased sleeping comfort and/or mattress life.

Accordingly, applicant desires foundations that can reduce mattress dip by providing increased mattress support.

SUMMARY

The current disclosure is directed to a variety of kits for making a foundation for a mattress, methods of assembling kits for shipping, methods of assembling foundations from kits, and foundations.

In one example of one kit embodiment, a kit includes a first side rail, a second side rail, a first end rail, a second end rail, and at least one center rail. The first and second side rails are configured to be positioned parallel to each other. The first and second end rails are configured to interface with the first and second side rails. The at least one center rail will typically be configured to be positioned parallel to the first and second side rails and to interface with the first and second end rails.

Kit examples will also typically include a plurality of slats, some of which may have different lengths. The kit described above may include, for example, an A slat having a length L-A, a B slat having a length L-B, wherein L-B is greater than L-A, and a C slat having a length L-C, wherein L-C is greater than L-B. When the various rails are interfaced, the A slat, B slat, and C slat may be positioned on slat-rests of the rails.

In contrast to traditional foundations, where all slats are positioned perpendicular to side rails, kits of the current inventions are configured such that at least a plurality of slats are non-perpendicular to the side rails. For example, the A slat, the B slat, and the C slat may each define an angle $\alpha$ in the range of 25° to 35°. A plurality of additional slats may define similar angles. For example, kits may include a pair of A slats, a pair of B slats, and a pair of C slats that define an angle $\alpha$ in the range of 25° to 35°. In some examples, at least some of the slats may be connected by at least one flexible line, e.g. fabric tape. In many examples, the fabric tape may maintain a desired spacing and order between slats.

The results include kits that allow for the creation of foundations having increased mattress support.

In some aspects of the disclosure, the rails and slats may be packaged together for shipping and storage in a substantially parallel longitudinal orientation.

The above summary was intended to summarize briefly some parts of the present disclosure. Kits, foundations, and related methods will be set forth in more detail in the figures and detailed description below. It will be apparent, however, that the detailed description is not intended to limit the present invention, the scope of which should be properly determined by the appended claims.

DETAILED DESCRIPTION OF THE DISCLOSURE

Figure 1:
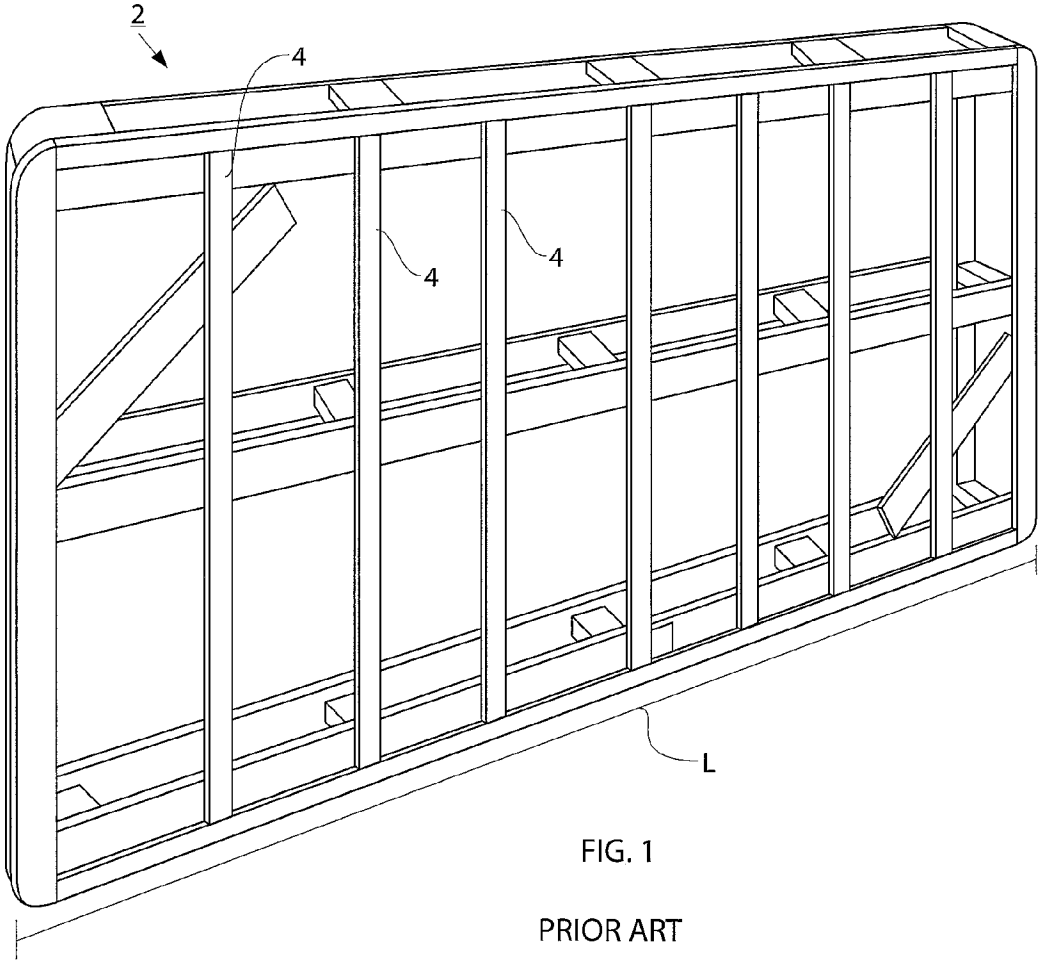
FIG. 1 PRIOR ART
FIG. 1 illustrates one example of a traditional foundation.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms. The illustrations are for the purpose of describing a preferred embodiment of the invention and are not intended to limit the invention thereto.

FIG. 1 is a perspective view of one example of a traditional mattress foundation example, referred to generally as 2. Foundation 2 includes a plurality of slats 4 positioned perpendicular to the length L of the foundation. Slats 4 support a mattress not shown in this picture.

Figure 2:
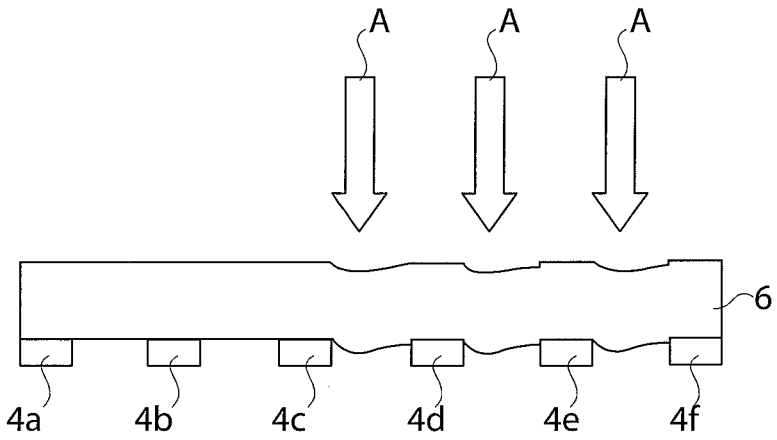
FIG. 2 illustrates a cutaway partial view of a foundation and a mattress, illustrating mattress dip.

FIG. 2 illustrates a partial cutaway view of a plurality of slats (4*a*, 4*b*, 4*c*, 4*d*, 4*e*, and 4*f*) from a traditional foundation supporting a mattress 6. While traditional foundations are sufficient in many situations, applicant believes that in some situations, improvement can be made. By way of example, in some situations a sleeper's downward force, illustrated by arrows A may cause the mattress to dip in between slats of the foundation (referred to herein generally as "mattress dip"). For example, mattress dip may occur between slats 4*c* and 4*d*, between slats 4*d* and 4*e* or elsewhere.

Figure 3:
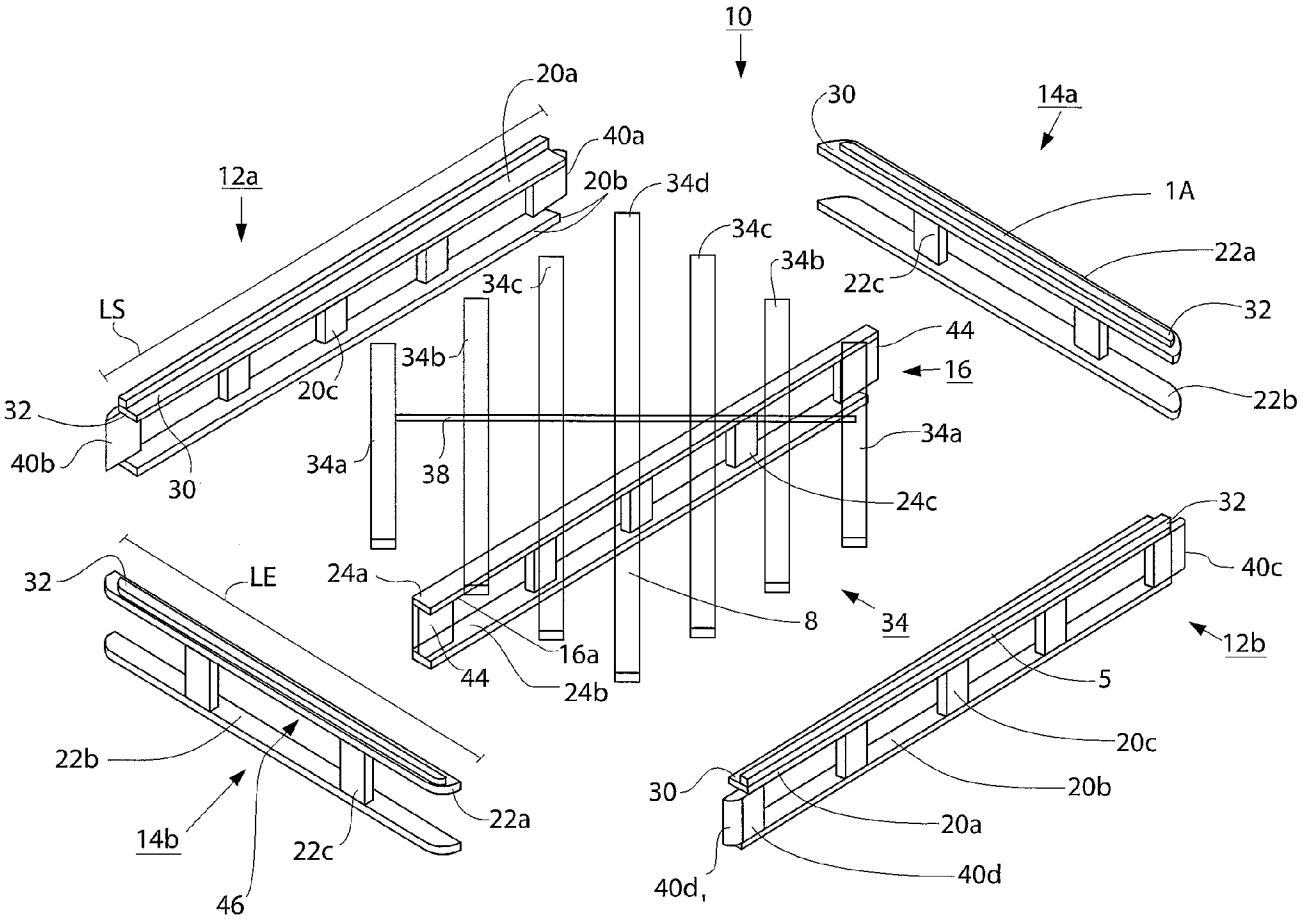
FIG. 3 illustrates an exploded perspective view of kit components for making a foundation according to the current disclosure.

FIG. 3 illustrates a perspective view of exemplary components of one example of a foundation kit as disclosed herein, referred to generally as kit 10. Kit 10 includes a first side rail 12*a*, a second side rail 12*b*, a first end rail 14*a*, a second end rail 14*b*, and at least one center rail 16. The use of the term "first" and "second" with the various rails is provided for clarity and antecedent basis rather than to mean a particular order or position. Similarly, the use of "center" is only intended to mean that the center rail is positioned, at least in part, between either the first and second end rails or the first and second side rails. The at least one center rail may or may not be centrally positioned.

The construction of the various rails may vary from embodiment to embodiment. For example, side rails may include a top piece 20*a*, a bottom piece 20*b* and a side filler block 20*c*. Similarly, end rails may include a top piece 22*a*, a bottom piece 22*b*, and an end filler piece 22*c*. The center rail may also include a top piece 24*a*, a bottom piece 24*b*, and a center filler piece 24*c*. In other examples, other rail constructions may be used, including, for example, solid rail pieces, or different spacer constructions.

In some aspects of the current disclosure, side rails may be considered to have a length L-S, and end rails may be considered to have a length L-E. The various dimensions of the various rails and rail components (e.g. top, bottom and filler pieces) may vary from example to example. Table 1 illustrates exemplary dimensions, which are in no way intended to be limiting. For example, fewer or more slats may change the illustrated dimensions in a manner that would be readily understandable to one of ordinary skill in the art, for example, using the disclosed slat angles α.

TABLE 1

| DESCRIPTION | TWIN | TWIN XL | FULL | QUEEN | SPLIT QUEEN | CAL KING |
|---|---|---|---|---|---|---|
| TOP END RAIL | 37½" | 37½" | 52½" | 59½" | 29½" | 35½" |
| TOP END FILLER | | | | | | |
| BOTTOM END RAIL | 37½" | 37½" | 52½" | 59½" | 29½" | 35½" |
| TOP SIDE RAIL | 74" | 79" | 74" | 79" | 79" | 83" |
| BOTTOM SIDE RAIL | 74" | 79" | 74" | 79" | 79" | 79" |
| TOP SIDE FILLER | 69" | 74" | 69" | 74" | 74" | 74" |
| TOP CENTER RAIL | 74" | 79" | 74" | 79" | 79" | 79" |
| BOTTOM CENTER RAIL | 69" | 74" | 69" | 74" | 74" | 74" |
| SLATS | 20" to 70" | 20" to 70" | 20" to 76" | A: 29" B: 52" C: 74" D: 76.5" | A: 29" B: 52" C: 74" D: 76.5" | 29" to 80" |
| CORNER BLOCK | 6.75" | 6.75" | 6.75" | 6.75" | 6.75" | 6.75" |
| CENTER BLOCK | 6.75" | 6.75" | 6.75" | 6.75" | 6.75" | 6.75" |
| SIDE BLOCK | 6.75" | 6.75" | 6.75" | 6.75" | 6.75" | 6.75" |

Further the first side rail, the second side rail, the first end rail, and the second end rail may include a slat-rest, e.g. slat-rests 30 seen in FIG. 3. Slat-rests in this example are defined by the top surface of the top piece, e.g. top surface 30 of top piece 20*a*. The width and length of the slat-rest may be variable, so long as they are configured to support a slat. For example, the width and length of the slat-rest may be equal to the width and length of the top piece of a side rail. In many examples, the dimensions of the slat-rest will be less than that of the top surface area of the rail. For example, as seen in FIG. 3, some slat-rests, e.g. those of the side or end rails, may be bound by a filler strip, e.g. strip 32. Filler strip function will be discussed in more detail below.

Kit 10 also includes a plurality of slats, referred to generally as slats 34. As seen, slats 34 do not have the same length. For example, A slats 34*a* may be considered to have a length L-A. B slats 34*b* may be considered to have a length L-B, wherein L-B is greater than L-A. C slats 34*c* may be considered to have a length L-C, wherein L-C is greater than L-B. D slat 34*d* may be considered to have a length L-D. As seen, L-A, L-B, and L-C are each less than L-S. In many examples L-D will similarly be less than L-S. In the example shown, the slats include a pair of A slats, a pair of B slats, a pair of C slats and a D slat, e.g., at least one pair, at least two pairs, or at least 3 pairs of the slats are substantially identical in length, e.g. within ±1 inch. In other examples, either more or fewer numbers of slats may be identical in length.

In many examples, at least some of slats 34 will be connected by at least one flexible line, e.g. line 38. Line 38 may be made from a variety of materials, e.g. any material capable of folding on itself and supporting its own weight, e.g. rope, string, strapping, webbing, ribbon, etc, and may have at least one of any number of cross-sectional shapes, e.g. round, flat, square, etc. In many examples, the flexible line will have a top side and a bottom side, e.g. a piece of nylon webbing, and flexible line may be considered attached to the slat on its bottom side. For example, line 38 may be considered to be a ribbon having a flat cross section, a top side, and a bottom side. The bottom side of the ribbon may be considered to be attached to slats 34.

Flexible lines are useful for serving any of a variety of purposes. For example, flexible lines may maintain the slats in a desired order for shipping, storage, or assembly. In FIG. 3, for example, line 38 maintains slats in the following order: A slat, B slat, C slat, D slat, C slat, B slat, A slat.

Flexible lines may also be useful for maintaining a predetermined distance between the slats. Distances may vary, for example based on slat number and the size of the foundation being constructed. In many examples, lines will maintain a distance between slats in the range of 5" to 12", more typically in the range of 6" to 10".

Kits may also include at least one corner block for interfacing, at least in part, a side rail to an end rail, e.g. at least one of a first corner block 40*a*, a second corner block 40*b*, a third corner block 40*c* and a fourth corner block 40*d*. In this example, first corner block 40*a* is configured to interface the first side rail to the first end rail; the second corner block 40*b* is configured to interface the first side rail to the second end rail; the third corner block 40*c* is configured to interface the second side rail to the first end rail; and the fourth corner block 40*d* is configured to interface the second side rail to the second end rail. It should be clear however that the use of first, second, etc. to describe the corner blocks is for the purpose of antecedent basis, and not to impart any particular order of construction or position. In many examples, corner blocks will include a curvature or rounding, for example, to avoid sharp corners. Further, it should be clear that "block" is not intended to mean single piece construction. Although the example corner blocks illustrated may be considered to be made from a single piece of wood, in other examples, corner blocks include multiple piece components that are fitted together or fastened. Corner blocks will often include curvature, e.g., curvature 40*d*1, at an outside edge, e.g. to create a slightly rounded edge in the assembled foundation.

Corner blocks will typically be configured to have a length that allows some portion of the corner piece to be received by a recess in an end rail and another portion of the corner block to be received by a recess in the side rail. For example, at least 0.5" to 3" may be received by a recess of either the side or end rail. In other examples, more or less may be received, so long as sufficient structural integrity is maintained for use as a foundation. In many examples, at least one of the corner blocks will be pre-interfaced with a rail, e.g. either the side rail or the end rail. In FIG. 3, corner blocks are shown as pre-interfaced with the side rails and the end rails each contain at least a pair of recesses for receiving corner blocks.

Kits may additionally include at least one center rail, e.g. center rail 16 as previously mentioned. Accordingly, kits may also include center blocks, e.g. center blocks 44, for interfacing center rails to end pieces. The number of center blocks may vary from example to example. For example, in kits having 2 center rails, 4 center blocks may be included. The interface of the center blocks to the center rails and end rails may be similar to as described for side and end rails. For example, each of the end rails may include a recess in between their end recesses for receiving at least a portion of the center block. For example, recess 46 defined by top piece 22*a*, bottom piece 22*b*, and blocks 22*c*, may be considered a recess for receiving a portion of the center block. In many examples, the center blocks will be pre-interfaced with the center rail. Pre-interfacing may be achieved by a variety of ways, e.g. glue, nail, screw, etc.

Figure 4:
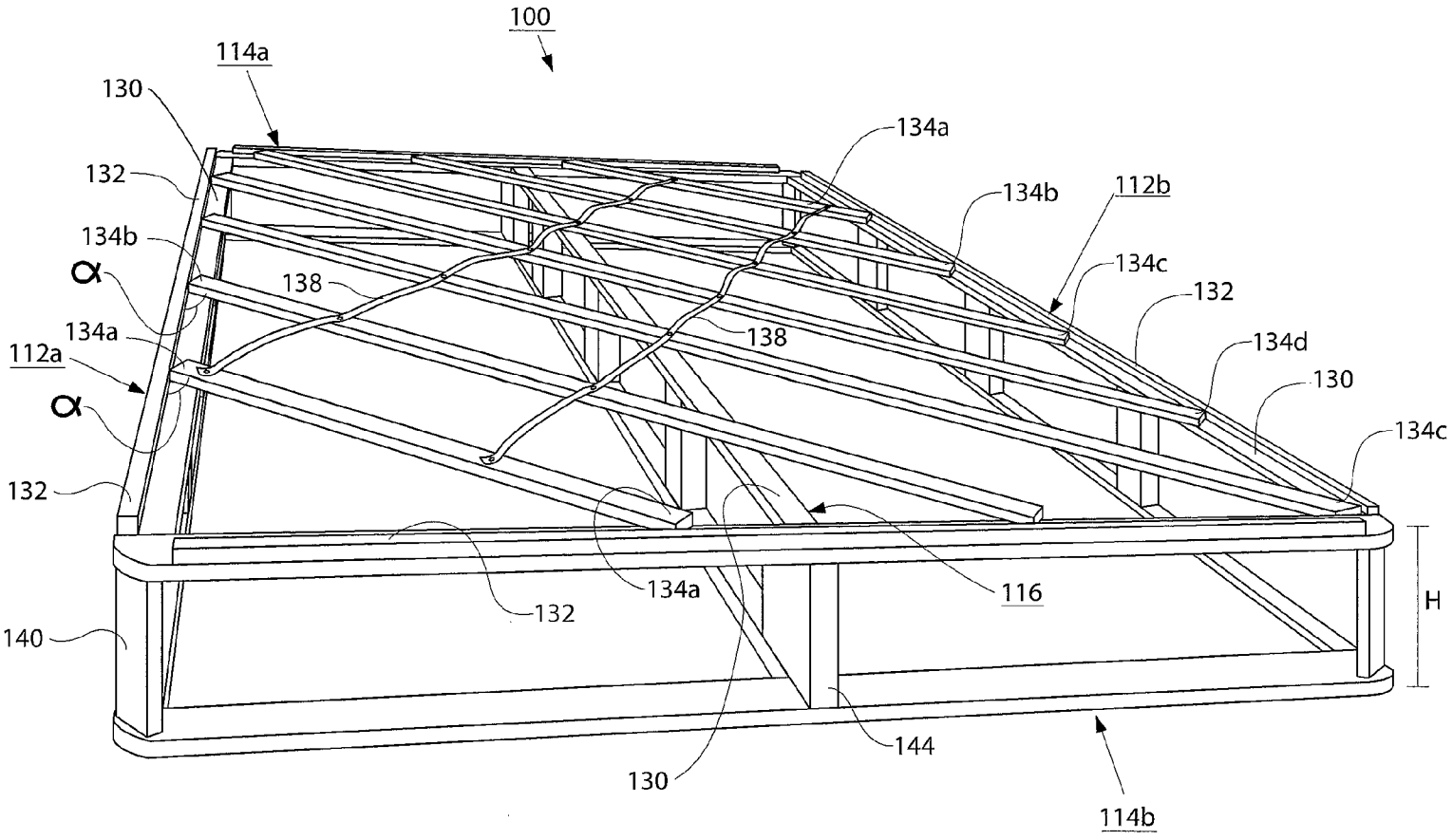
FIG. 4 illustrates a foundation according the current disclosure.

FIG. 4 illustrates a perspective view of a foundation 100 assembled from a kit example as described herein. As seen, foundation 100 includes side rail 112*a*, side rail 112*b*, end rail 114*a* and end rail 114*b*. Rails can also be seen to include filler strips 132. Corner blocks, e.g. blocks 140, and center blocks, e.g. blocks 144, interface rail components of the kit. Slats 134 are resting on slat-rests 130. For example, A slat 134*a* is resting on the on the slat-rest of side rail 112*a* and on the slat-rest of end rail 114*b*. The B slat 134*b* is resting on the slat-rest of side rail 112*a* and on the slat-rest of end rail 114*b*. The B slat is also resting on the slat-rest of center rail 116. The C slat is resting on the slat-rest of side rail 112*a*, center rail 116 and end rail 114*b*. In some examples, C slats may also rest, at least in part on the opposite side rail, e.g. partially on the slat-rest of end rail 114*b* and partially on the slat-rest of side rail 112*b*, or entirely on the slat-rest of 112*b*. Some slats, such as D slat may rest on the slat-rest of 112*a*, the slat-rest of center rail 116, and the slate-rest of side rail 112*b*. A plurality of additional slats may be similarly rested on slat-rests.

Slats have been interfaced with the slat rests, e.g., by glue, nail, screw, etc. The slat rests are configured so that the tops of the installed slats will be at substantially the same height H. Because of variability in construction materials, however, there may be some variability in the assembled slat height, e.g. H±0.5 inches.

As seen, when assembled, the slats define a similar acute angle (referred to herein as "angle") alpha α. For example, A slat 134*a*, B slat 134*b*, and C slat 134*c* each define an angle α with the side rail. For at least a plurality of slats, the angle α is not 90°, e.g for at least 2, at least 3, at least 4, at least 5, at least 6, or at least all of the slats. In many examples, the angle α includes a least one angle in the range of 25° to 35°. In most examples, applicant has surprisingly found that at least one angle in the range of 28° to 30° provides the best results for improved mattress support.

Figure 4A:
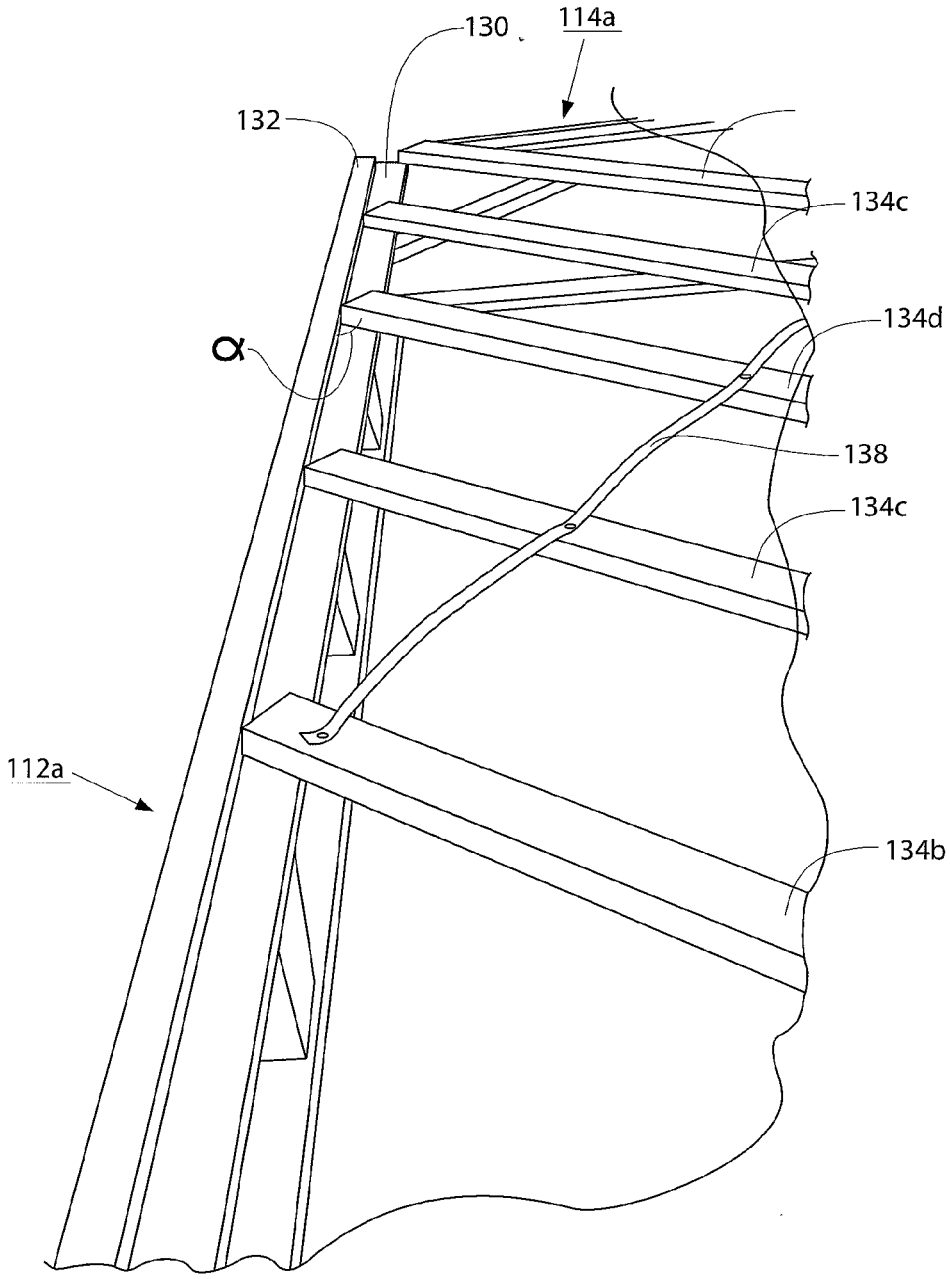
FIG. 4*a* illustrates a partial close up view of the foundation from FIG. 4.

FIG. 4*a* illustrates a close-up partial view of slats.

Figure 5:
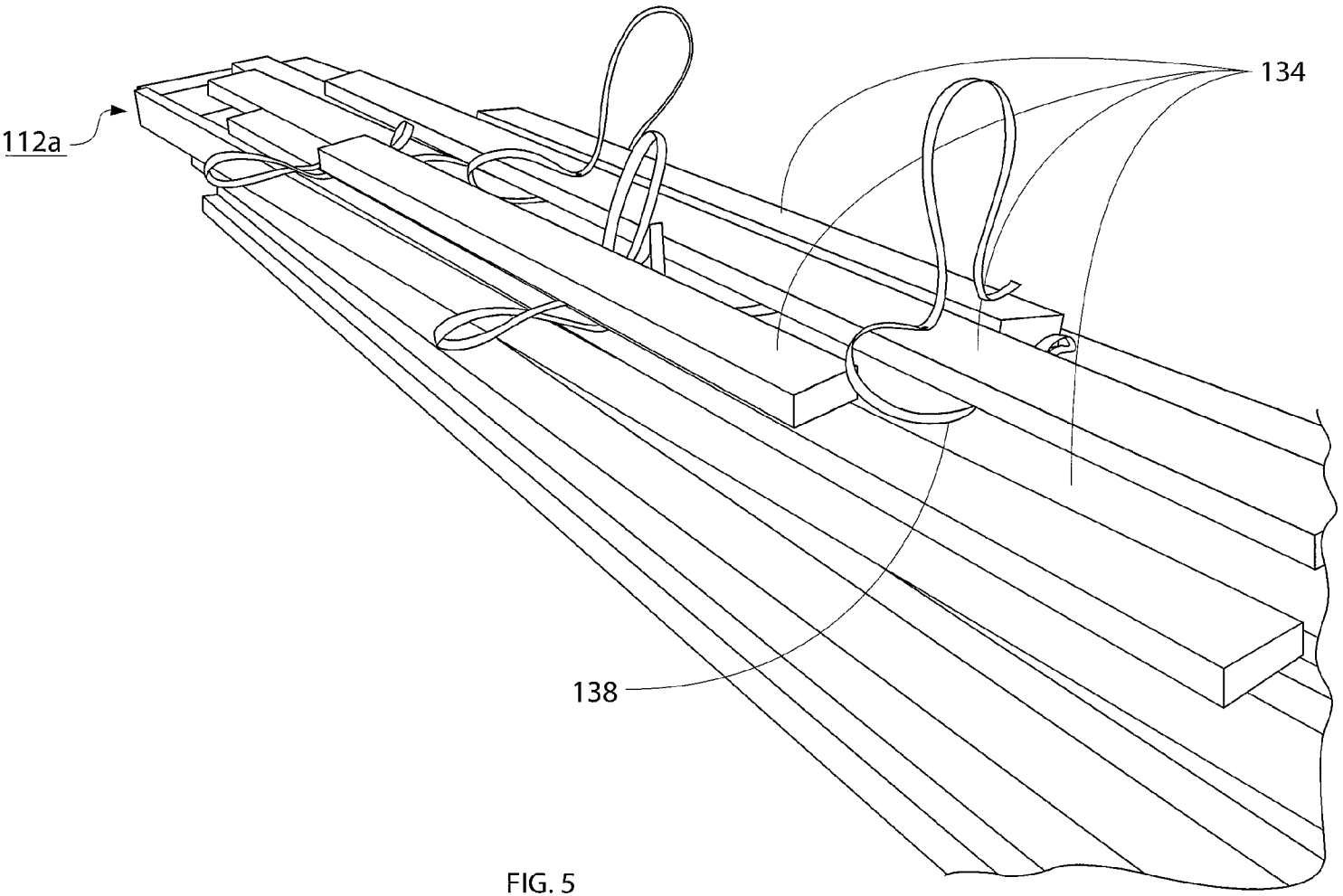
FIG. 5 illustrates a view of a kit.

The current disclosure is also directed to a variety of methods. In one embodiment, the disclosure is directed to methods of assembling kits for shipping. In one example, a method includes manufacturing a first side rail having a slat-rest and a length L-S and manufacturing a second side rail for positioning parallel to the first side rail, the second side having a slat-rest. The example may also include manufacturing a first end rail configured to interface with the first side and the second side and a second end rail configured to interface with the first side rail and the second side rail. The first end rail and the second end rail each having a slat rest. The example also includes manufacturing at least one center rail configured to interface with the first end rail and the second end rail, the at least one center rail having a slat-rest. The center rail, side rails, and end rails may be similar to any of those previously described. FIG. 5 illustrates one example of a kit assembled for shipping.

In this embodiment example, the method also includes manufacturing a plurality of slats including at least an A slat having a length L-A, a B slat having a length L-B, wherein L-B is greater than L-A, and a C slat having a length L-C, wherein L-C is greater than L-B. Typically L-A, L-B, and L-C are each less than L-S. The example also includes connecting the plurality of slats with at least one flexible line, wherein the at least one flexible line maintains a predetermined distance X between the A slat and the B slat, and between the B slat at the C slat.

Once manufactured, methods may also include orienting the first side rail, the second side rail, the first end rail, the second end rail, the at least one center rail, and the plurality of connected slats in a substantially parallel longitudinal orientation for at least one of shipping or storage. Typically, the oriented kit will be bound to maintain its orientation for a desired duration, e.g. until assembly. Binding may be by any material having the strength sufficient to maintain the kit in the orientation, e.g., wire, plastic strapping, packaging tape, etc.

Methods of the current disclosure are also directed to assembling a foundation for a mattress. In one example, a method includes receiving a kit, such as any of the described above. For example, the kit may include a first side rail having a slat-rest and a length L-S; a second side rail having a slat-rest; a first end rail having a slat-rest; a second end rail having a slat-rest; at least one center rail having a slat-rest; and a plurality of slats. The plurality of slats may vary from example to example. For example, they may include an A slat having a length L-A, a B slat having a length L-B, wherein L-B is greater than L-A, and a C slat having a length L-C, wherein L-C is greater than L-B. Other slats may also be included. Typically, L-A, L-B, and L-C are each less than L-S.

Assembly methods may also include positioning the first side rail, the second side rail, and the at least one center rail in parallel; interfacing the first end rail with the first side rail, the second side rail, and the at least one center rail; and interfacing the second end rail with the first side rail, the second side rail, and the at least one center rail. The interfacing creates slat-rests having a similar height of H.

Figure 6:
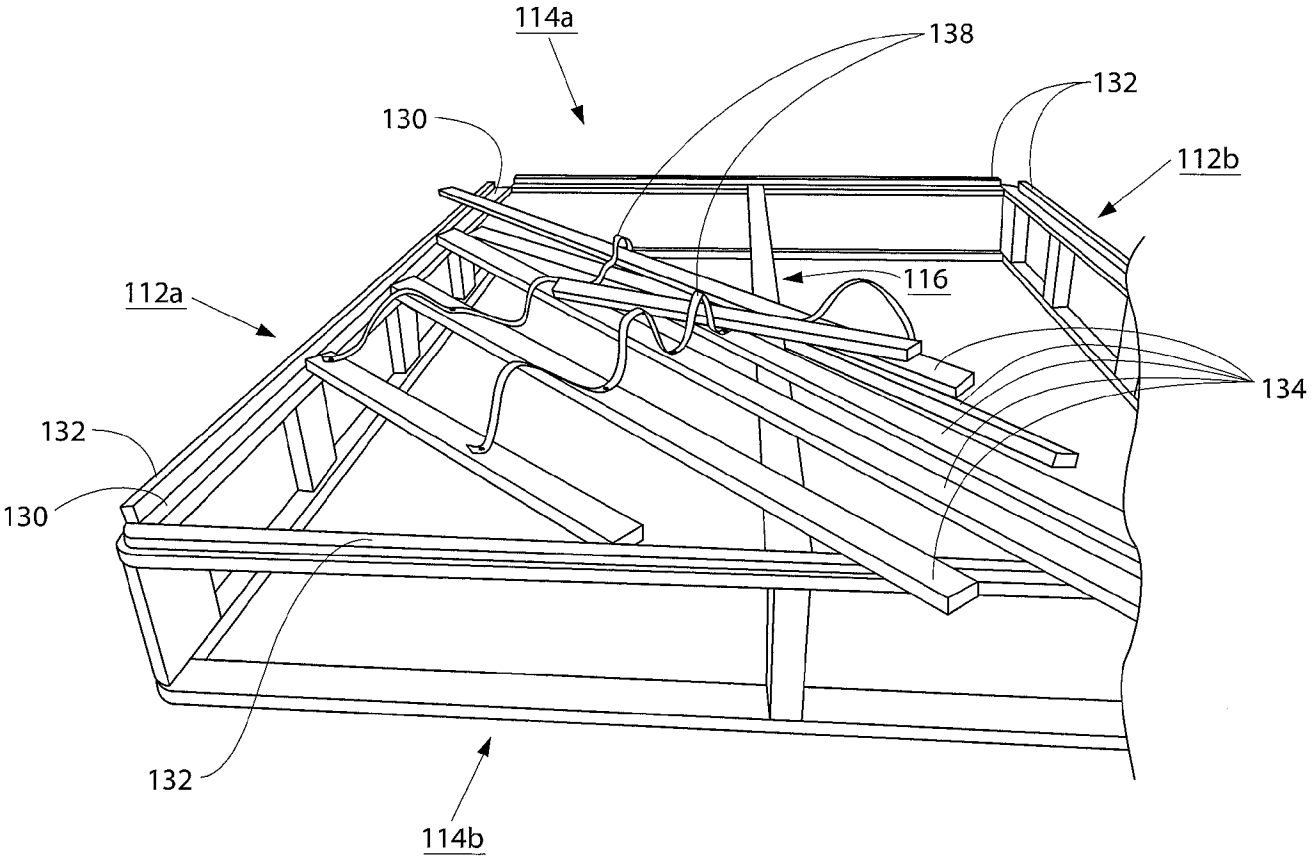
FIG. 6 illustrates a view of a partially assembled foundation.

Once the rails are interfaced, the plurality of slats may be positioned on the plurality of slat-rests to create the following sequence: A slat, B slat, and C slat. In many examples, as described above, the sequence may be symmetrical, e.g: A slat, B slat, C slat, C slat, B slat, A slat. Other examples, include A slat, B slat, C slat, D slat, C slat, B slat, A slat. FIG. 6 illustrates a partially assembled kit example, with several slats resting on slat-rests.

The positioning of the slats may be facilitated by at least one flexible line connecting the slats, as described above. The at least one flexible line is useful for at least one of maintaining the slats in the proper order and maintaining the proper distance between slats. Additionally, the at least one flexible line may also be useful for maintaining the proper angular orientation between the slats, particularly if more than one flexible line is used, or if a single flexible line is used, its attachment to the slats does not allow for slat rotation relative to the line.

Methods also include attaching the A slat, the B slat and the C slat such that each define an angle α with side rails when installed. As noted above, typically at least a plurality of slats will have an angle α that is not 90°. More typically, at least a plurality of the slats will include at least one angle in the range of 25° to 35°. Rails will often also include filler strips, e.g. filler strips 32 and 132 discussed above. Prior to attachment, proper slat positioning may be facilitated, at least in part, by abutting the ends of one of the terminal slats, e.g an A slat against the filler strip of a side rail and the filler strip of an end rail, and then performing a similar step for the opposite terminal slat, e.g. the opposite A slat if symmetrical slat construction is used. The result is that, when at least one flexible connector is used, all slats in between the terminal slats should be approximately positioned in their desired angular orientation, requiring only minimal adjustment before attachment. Similar positioning may also be achieved without the use of flexible connectors, for example, by abutting the ends of each slat against filler strips. Proper positioning may be achieved by markings on the slat rest, shape of the slat ends, etc.

The disclosure provided herein thus provides a variety of improvements in the art including increased mattress support by addressing at least one of the above noted, or additional, problems. Further, a user's body weight at a given transverse plane will typically be supported by at least two slats using the present invention, which applicant believes contributes, at least in part, to increased comfort. In addition, foundations as disclosed herein will often provide better support to memory foam type mattresses, which applicant believes exhibit the potential for unnecessary sagging under existing technologies.

Numerous characteristics and advantages have been set forth in the foregoing description, together with details of structure and function. The disclosure, however, is illustrative only, and changes may be made in detail, especially in matters of shape, size, and arrangement of parts, within the principle of the invention, to the full extent indicated by the broad general meaning of the terms in which the general claims are expressed.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein, and every number between the end points. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. Additionally, any reference referred to as being "incorporated herein" is to be understood as being incorporated in its entirety.

It is further noted that, as used in this specification, the singular forms "a," "an," and "the" include plural referents unless expressly and unequivocally limited to one referent.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A kit for making a foundation for a mattress, the kit comprising:

a first side rail having a slat-rest and a length L-S;

a second side rail for positioning parallel to said first side, the second side having a slat-rest;

a first end rail configured to interface with said first side rail and said second side rail, the first end having a slat-rest;

a second end rail configured to interface with said first side rail and said second side rail, the second end rail having a slat-rest;

at least one center rail configured to interface with the first end rail and the second end rail, the at least one center rail having a slat-rest; and a plurality of slats including an A slat having a length L-A, a B slat having a length L-B, wherein L-B is greater than L-A, a C slat having a length L-C, wherein L-C is greater than L-B, and wherein L-A, L-B, and L-C are each less than L-S, and wherein the A slat is configured to rest on the slat-rest of the first side rail and on the slat-rest of the first end rail the B slat is configured to rest on the slat-rest of the first side rail and on the slat-rest of the first end rail, and the C slat is configured to rest on the slat-rest of the first side rail and on the slat-rest of the first end rail or the slat-rest of the second side rail.

2. The kit of claim 1, further including at least one flexible line connecting the A slat, the B slat and the C slat.

3. The kit of claim 2, wherein the line connecting the A slat, the B slat and the C slat has a top side and a bottom side.

4. A kit as claimed in claim 2 wherein the flexible line attaches to the A slat, B slat and C slat at points spaced apart on the flexible line, so that the slats are spaced from one another if the line is extended its full length.

5. The kit of claim 1, wherein the connection of the flexible line maintains a predetermined spaced distance X between the A slat and the B slat, and between the B slat and the C slat.

6. The kit of claim 5, wherein the predetermined distance X includes at least one distance in the range of 5" to 12".

7. The kit of claim 5, wherein, when assembled, the A slat and the first side define an angle $\alpha$, the B slat and the first side define an angle $\alpha$, and the C slat and the first side define an angle $\alpha$, wherein $\alpha$ is not 90°.

8. The kit of claim 7, wherein a includes a least one angle in the range of 25° to 35°.

9. The kit of claim 7, wherein a includes a least one angle in the range of 28° to 30°.

10. The kit of claim 1, wherein, when assembled, the slat-rests of the first side rail, second side rail, first end rail, second end rail, and center rail all have a height H±0.5 inches.

11. The kit of claim 1, further including at least one of a D slat, having a length L-D, wherein L-D is greater than L-C, and wherein L-D is less than L-S, a second A slat having a length L-A, a second B slat having a length L-B, and a second C slat having a length L-C.

12. The kit of claim 1, further including at least two of a D slat, having a length L-D, wherein L-D is greater than L-C, and wherein L-D is less than L-S, a second A slat having a length L-A, a second B slat having a length L-B, and a second C slat having a length L-C.

13. The kit of claim 1, further including at least three of a D slat, having a length L-D, wherein L-D is greater than L-C, and wherein L-D is less than L-S, a second A slat having a length L-A, a second B slat having a length L-B, and a second C slat having a length L-C.

14. The kit of claim 1, further including at least all of a D slat, having a length L-D, wherein L-D is greater than L-C, and wherein L-D is less than L-S, a second A slat having a length L-A, a second B slat having a length L-B, and a second C slat having a length L-C.

15. The kit of claim 1, including at least one of a first corner block configured to interface the first side rail to the first end rail;

a second corner block configured to interface the first side rail to the second end rail;

a third corner block configured to interface the second side rail to the first end rail; and a fourth corner block configured to interface the second side rail to the second end rail.

16. The kit of claim 15, wherein the first corner block and the second corner block are pre-interfaced with the first side rail, the third corner block and the fourth corner block are pre-interfaced with the second side rail, the first end rail defines at least two recesses, each for receiving a portion of a corner block, and the second end rail defines at least two recesses, each for receiving a portion of a corner block.

17. A foundation assembled from a kit of claim 1.

18. The kit of claim 1, further including at least two flexible lines connecting the A slat, the B slat and the C slat, the two flexible lines being spaced apart from one another as they connect to each slat.

19. A kit as claimed in claim 1 wherein each slat rest includes less than a top surface of its rail and is bound by a filler strip.

20. A kit for making of a foundation for a mattress, the kit comprising:

a first side rail having a slat-rest and a length L-S, the first side rail interfaced with a first corner block at one end and second corner block at the opposite end;

a second side rail for positioning parallel to the first side rail, the second side rail having a slat-rest and being interfaced with a third corner block at one end and a fourth corner block at the opposite end;

a first end rail configured to interface with the first side rail and the second side rail, the first end rail having a slat-rest;

a second end rail configured to interface with the first side rail and the second side rail, the second end rail having a slat-rest;

at least one center rail configured to interface with the first end rail and the second end rail, the at least one center rail having a slat-rest; and a plurality of slats including a pair of A slats, each having a length L-A, a pair of B slats, each having a length L-B, wherein L-B is greater than L-A, a pair of C slats, each having a length L-C, wherein L-C is greater than L-B, and a D slat having a length L-D, wherein L-D is greater than L-C, and wherein L-A, L-B, and L-C and L-D are each less than L-S; and at least one flexible line maintaining the plurality of slats in the following order: A slat, B slat, C slat, D slat, C slat, B slat, A slat;

wherein, when assembled and resting on at least two of the slat rests, the pair of A slats, the pair of B slats, the pair of C slats, and the D slat each define an angle $\alpha$ including a least one angle in the range of 25° to 35°.

21. A kit for making of a foundation for a mattress, the kit comprising:

two side rails and two end rails, with corner blocks configured to join each side rail to each end rail at a 90 degree angle, the two side rails being of the same length as each other and each of the end rails being of the same length as each other, so that the side rails and end rails assembled with the corner blocks form a right quadrilateral shape, and each of the side and end rails having a slat-rest, and a plurality of slats, the slats being of progressively staggered in length so that when diagonally disposed on the slat-rests of the rails as assembled into the right quadrilateral shape, the slats span the rails diagonally, wherein the plurality of slats includes an A slat configured to rest on the slat-rest of a first side rail and on the slat-rest of a first end rail, the B slat is configured to rest on the slat-rest of the first side rail and on the slat-rest of the first end rail and the C slat is configured to rest on the slat-rest of the first side rail and on the slat-rest of the first end rail or the slat-rest of a second side rail.

22. The kit of claim 21 wherein when diagonally disposed on the slat-rests of the rails as assembled into the right quadrilateral shape, the slats span the rails diagonally and form angles to the side rails in the range of 25° to 35°.

* * * * *

UNITED STATES PATENT AND TRADEMARK OFFICE

CERTIFICATE OF CORRECTION

PATENT NO. : 8,935,819 B1
APPLICATION NO. : 13/625378
DATED : January 20, 2015
INVENTOR(S) : Rick Hartley It is certified that error appears in the above-identified patent and that said Letters Patent is hereby corrected as shown below:

In the claims

Col. 8, in Claim 8, line 34, after the word wherein, the --a-- should be "α"

Col. 8, in Claim 9, line 36, after the word wherein, the --a-- should be "α"

Col. 10, in Claim 21, line 27, after the word being, the word "of" should be deleted Signed and Sealed this
Twelfth Day of May, 2015

Michelle K. Lee

Michelle K. Lee
*Director of the United States Patent and Trademark Office*